United States Patent [19]

Labbe

[11] 4,248,139

[45] Feb. 3, 1981

[54] MANUFACTURE OF FILTERS FOR CIGARETTES

[75] Inventor: Francis A. M. Labbe, Neuilly-sur-Seine, France

[73] Assignee: Molins Limited, England

[21] Appl. No.: 15,906

[22] Filed: Feb. 28, 1979

Related U.S. Application Data

[63] Continuation of Ser. No. 811,142, Jun. 28, 1977, abandoned.

[30] Foreign Application Priority Data

Jul. 2, 1976 [GB] United Kingdom ..... 27583/76
Dec. 22, 1976 [GB] United Kingdom ..... 53688/76

[51] Int. Cl.[3] ..... A24C 5/50
[52] U.S. Cl. ..... 493/4; 73/38; 493/42
[58] Field of Search ..... 93/1 C, 77 FT; 131/66 R, 261 R, 21 B; 73/38

[56] References Cited

U.S. PATENT DOCUMENTS

| | | | |
|---|---|---|---|
| T941,011 | 12/1975 | Morrison et al. | 93/1 C |
| 3,813,996 | 6/1974 | Labbe et al. | 93/1 C |
| 3,941,036 | 3/1976 | Molins et al. | 93/1 C |
| 3,974,007 | 8/1976 | Greve | 93/1 C X |
| 4,064,791 | 12/1977 | Berger | 93/1 C |

FOREIGN PATENT DOCUMENTS

| | | | |
|---|---|---|---|
| 888479 | 1/1962 | United Kingdom | 93/1 C |
| 1295864 | 11/1972 | United Kingdom | 93/1 C |

*Primary Examiner*—James F. Coan
*Attorney, Agent, or Firm*—Craig & Antonelli

[57] ABSTRACT

A machine for making cigarette filters from filter tow includes a tow fluffing unit for blowing air into the tow before it is compressed; a suction wheel which compresses the tow while extracting air therefrom; and a tongue which further compresses and shapes the tow and includes longitudinally spaced pressure tappings by which the pressure drop through the tow is detected. The tow feed rate is adjusted automatically to maintain a constant pressure drop. Also, the consumption of tow is monitored and the amount of tow stretching is adjusted automatically to minimize the consumption.

19 Claims, 15 Drawing Figures

MANUFACTURE OF FILTERS FOR CIGARETTES

This is a continuation of application Ser. No. 811,142 filed June 28, 1977 now abandoned.

One aspect of this invention is concerned with an improvement in the control of cigarette filter manufacture described in U.S. defensive publication No. T941,011. Publication No. T941,011 describes a means of sensing the pressure drop through the filter tow (which measurement is used to control the tow feed) by means of a pressure tapping near the upstream end of the tongue which compresses the tow to its final cross-section, i.e. that of the finished filter rods.

Filter tow commonly comprises crimped fibres of cellulose acetate, but it could in principle be of other materials having similar physical characteristics.

We have discovered that the monitoring of pressure drop is best carried out after the main compression of the tow has occurred; i.e. where the cross-section is not very much greater than the cross-section of the finished rod, and where the positions of the tow fibres are more settled and are less subject to subsequent alteration by air moving through the tow or by drag caused by the tongue. By sensing the pressure drop in this way, for example near the downstream end of the tongue (in contrast with the pressure drop measurement at the upstream end of the tongue as in publication T941,011), we achieve a better signal which we believe will not only be stronger but also more reliable.

The tow feed is preferably controlled by proportionally adjusting the speeds of all rollers feeding the tow, that is by adjusting the speeds upwards or downwards by the same proportion so as not to alter the amount by which the tow is stretched while moving between successive rollers. Alternatively it is possible to arrange the tow feed so that the desired control can be achieved by altering the speed of only one pair of cooperating rollers so as to alter the amount by which the tow is stretched.

In one preferred arrangement according to this invention, before the tow reaches the tongue it is laterally compressed, preferably to approximately its final cross-section, by a suction wheel or other suction conveyor. Upstream of the suction conveyor there is preferably a tow fluffing device arranged to blow air into the tow, preferably through an annular air outlet around the tow; the suction conveyor in this case cooperates with the fluffing device by drawing excess air out of the tow before the tow passes under the tongue.

Unless the tongue is of highly wear-resistant material, the pressure drop sensing device is preferably located slightly upstream of the downstream end portion of the tongue so as to avoid the area of the tongue in which there tends to be the greatest amount of wear.

Other aspects of the invention will be clear from the following description and claims.

Preferred examples of machines according to this invention are shown in the accompanying drawings. In these drawings.

Figure 1:
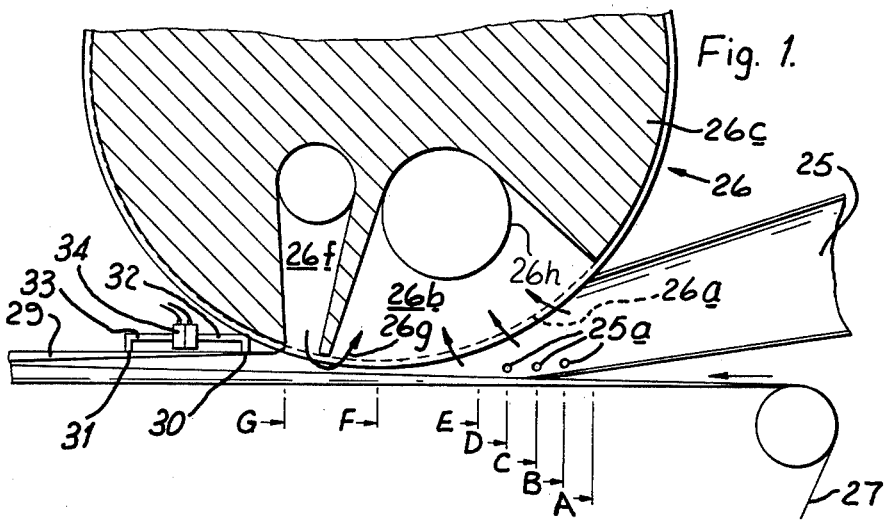
FIG. 1 is a fragmentary partly sectioned view of one machine.

The machine shown in FIG. 1 includes a condensing cone 25 into which cellulose acetate or other tow is fed through the right hand end of the cone. The cone begins the compression of the tow, and this compression is continued by a suction wheel 26 comprising an air-pervious rim **26*a* mounted between side walls 26*d* and 26*e* (see FIG. 2F). It should be noted that the rim 26*a* is recessed from the outer edge of the walls 26*d* and 26*e*** so as to form a shallow circumferential groove around the wheel.

Between the side walls **26*d* and 26*e* of the wheel there is a fixed member 26*c* formed with a recess 26*b* which is connected with a source of suction via a port 26*h* so that air is drawn inwards through the rim 26*a* of the wheel, as shown by the approximately radial arrows in FIG. 1**.

Figure 2A:
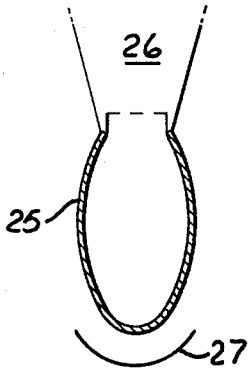
FIGS. 2A to 2G are sections, on a larger scale, on the lines A to G in FIG. 1.
Figure 2B:
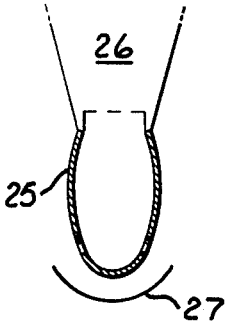
Figure 2C:
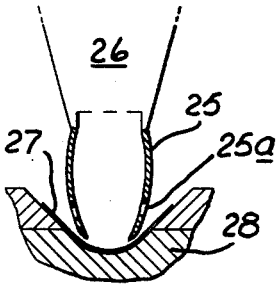
Figure 2D:
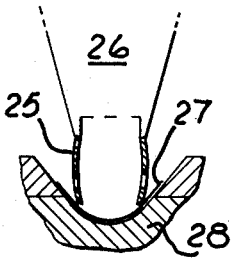
Figure 2E:
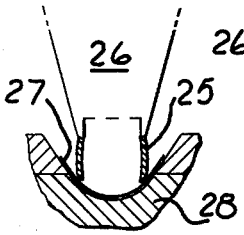
Figure 2F:
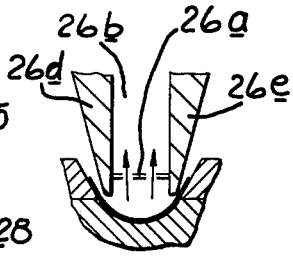
Figure 2G:
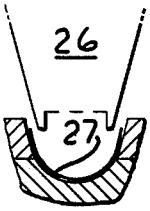

The cone 25 is cut away to allow the suction wheel 26 to enter the cone to grip the tow and to compress it between the wheel and a wrapper web 27. The decreasing cross-section of the passage formed between the wheel and the web 27 is shown by FIGS. 2C to 2E. Further compression of the tow occurs up to the section line F, at which point the cross-sectional area of the tow is preferably approximately equal to and certainly not much greater than the cross-sectional area of the final rod, e.g. 60 square mm. where the final rod cross-section is about 50 square mm.

At the section line G, the tow parts from the wheel, and its compression and final shaping is continued by a tongue 29. The slight increase in cross-section of the channel between the wheel and web 27 between the section lines F and G facilitates the action of the tongue (which serves in effect also as a stripping shoe) in stripping the tow from the wheel. Furthermore, the fixed member **26*c* is formed with a second recess 26*f* which is supplied with air at atmospheric or above-atmospheric pressure so that air flows outwards from the recess 26*f* and helps to remove the tow from the periphery 26*a* of the wheel. Substantially all the air flowing out of the recess 26*f* is drawn into the recess 26*b*, as shown generally by the arrow 26*g***.

The cone 25 may be formed with a number of apertures **25*a*** on both sides, as shown in the drawings.

It will be understood that the main compression of the tow is carried out by the wheel 26. Some further compression and shaping of the tow is achieved by the tongue 29, which converges slightly towards the wrapper web 27 and is appropriately shaped in cross-section so as to form the tow into a cylindrical cross-section. The paper is supported throughout by a base member 28 formed with a longitudinal groove of curved cross-section in its upper surface in which the web 27 moves.

The tongue 29 is formed with two apertures providing pressure tappings at longitudinally spaced points 30 and 31 from which pipes 32 and 33 deliver pressure signals to a comparator device 34. An electrical output from the comparator device 34 depends upon the pressure difference at the two pressure tappings and is indicative of the pressure drop through the tow. The output of the comparator may be used to control the rate at which tow is fed into the cone 25 so as to maintain a substantially constant pressure drop.

In order to avoid or minimise air leakage from or into the tow between the tongue and the wrapper web 27, the edges of the wrapper web 27 may be pressed against the sides of the tongue by air pressure supplied through slots or apertures in the adjacent parts of the base member 28. This pressure on the web 27 would in practice be transmitted via a woven tape (not shown) by which the web 27 would be supported in the usual way.

The air-pervious rim portion 26*a* of the wheel 26 may, for example, be a very fine metal gauze (e.g. with 0.010 inch diameter holes) or a woven tape, e.g. of nylon.

Figure 3:
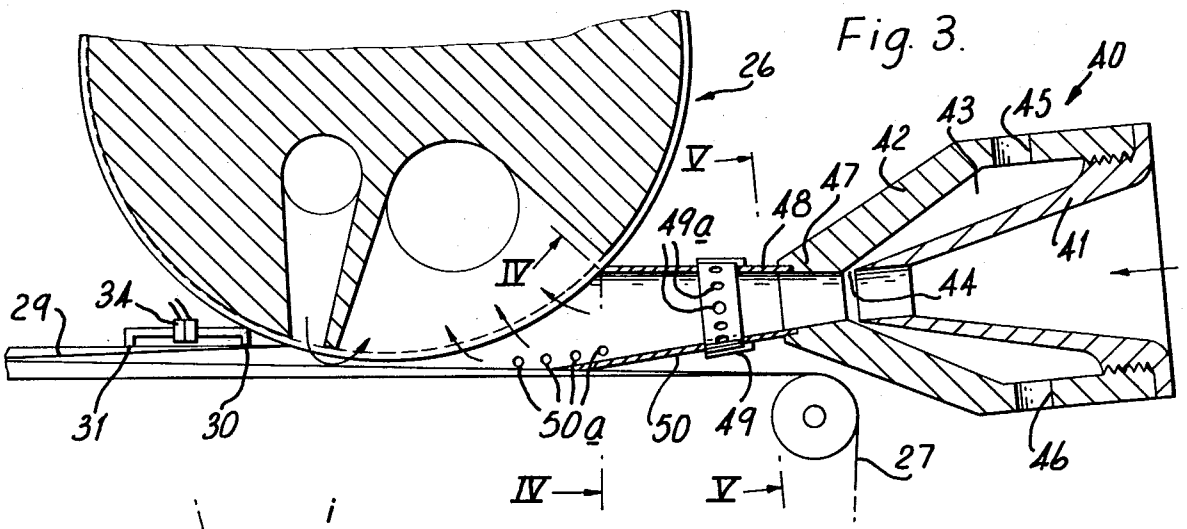
FIG. 3 is a fragmentary partly sectioned view of a different machine.

FIG. 3 shows an alternative machine which is basically the same as that shown in FIG. 1 in regard to the suction wheel 26, wrapper web feed 27, tongue 29, and the pressure drop measuring device including the comparator 34. However, the tow feed upstream of the wheel 26 is different.

In FIG. 3 the tow is fed initially through a fluffing unit 40 comprising a conical inner part 41 and a surrounding outer part 42 which defines with the inner part 41 an annular space 43 having an annular outlet 44. Compressed air is applied to the space 43 through inlets 45 and 46 to produce an annular flow of air inwards into the tow through the outlet 44, e.g. at a flow rate of about 6 cubic feet/minute. This flow of air counters the tendency for the crimping of the cellulose acetate fibres to be removed by stretching. In other words, the fluffing unit tends to maintain or restore the crimping of the fibres which is necessary to provide the desired pressure drop through the finished filter rod.

Figure 4:
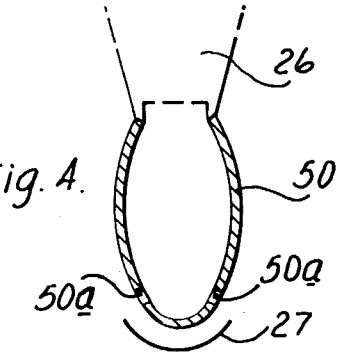

The fluffing unit 40 has an outlet portion 47 which is joined via a duct 48 and a connecting ring 49 to a duct 50 which feeds the tow towards the suction wheel 26. The inner part 41 of the fluffing unit is of circular cross-section, as is the outlet 47; and the duct 48, the connecting ring 49 and the duct 50 change progressively from a circular cross-section to an oval cross-section as shown in FIG. 4, which is a cross-section on the line IV—IV.

The combination of the fluffing unit 40 with the suction wheel 26 is useful in that it enables more air to be blown into the tow by the fluffing unit than would be possible without the suction wheel 26. This is because the suction wheel draws the air forward (preventing a reverse flow of air which could otherwise occur) and removes most of the air from the tow before the tow enters the region below the tongue 29.

The connecting ring 49 may have apertures 49*a* to let in more air from the atmosphere if necessary; the ring may be closely surrounded by a flexible sleeve formed with a similar set of holes which can be brought partly or fully into alignment with the holes 49*a* by rotation of the sleeve to control the air flow. In addition the duct 50 may have a number of air inlet apertures 50*a* near the wheel 26 along both sides of the duct as shown in the drawings.

Figure 6:
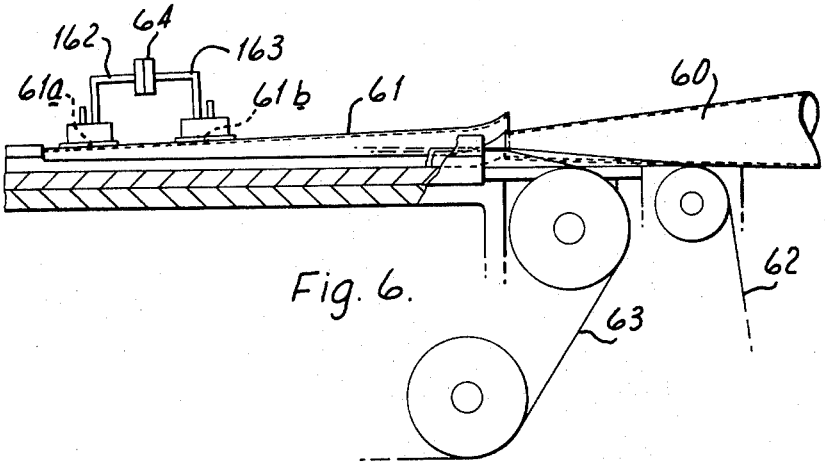
FIG. 6 is a diagrammatic side view of another machine in the region of the tongue.

The machine shown in FIG. 6 includes a tow condensing cone 60. Filter tow (not shown) is fed into the right-hand end of the cone 60 and is laterally compressed during its passage through the cone.

As the tow emerges from the left-hand end of the cone 60 it is confined between a tongue 61 and a wrapper web 62 which is already at that stage curved into a trough-like section, as shown in FIG. 2C. The web 62 is carried by a woven garniture tape 63 which supports and drives the web.

The tongue 61 shapes the tow and, in cooperation with the web 62, compresses it to substantially its final circular cross-section.

Figure 7:
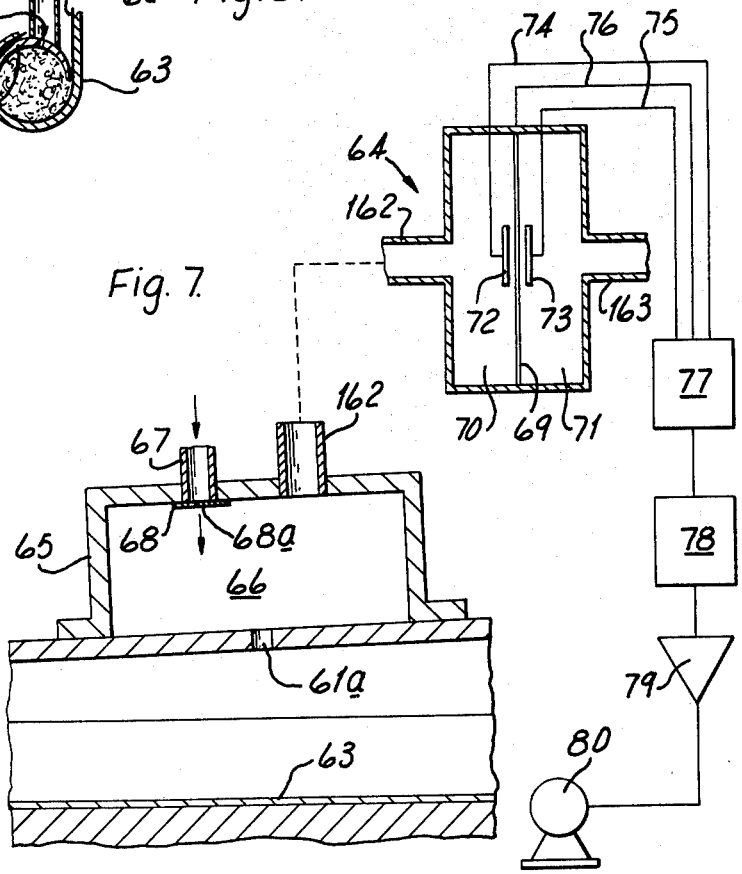
FIG. 7 shows how each of two pressure tappings in the tongue may be arranged, and shows diagrammatically a control circuit.

Near the downstream end of the tongue 61 there are two pressure tapping points 61*a* and 61*b*. The pressure in the tongue at these points is fed by pipes 162 and 163 to a comparator device 64 which may be as shown in FIG. 7. A signal from the comparator device 64 is used to control the tow feed so as to maintain a substantially constant pressure difference between the tapping points 61*a* and 61*b*.

Figure 5:
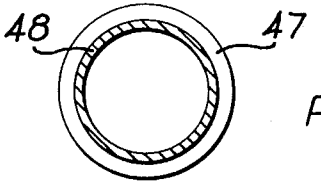
FIGS. 4 and 5 are sections, on a larger scale, on the lines IV—IV and V—V in FIG. 3.

Each pressure tapping in FIG. 6 and in FIGS. 1 and 5 may be made as shown in FIG. 7, which shows the pressure tapping at point 61*a*. The tongue has an aperture 61*a* which is covered by a housing 65 secured to the tongue and defining a chamber 66. The pipe 162 leads from the chamber 66 to the comparator 64 as shown. Air at above-atmospheric pressure is supplied into the chamber 66 through a pipe 67. A disc 68 formed with a small aperture 68*a* serves as an orifice producing a drop in pressure of the air from the pipe 67 as it enters the chamber 66.

The arrangement is such that the pressure in the chamber 66 is slightly greater than the pressure in the tongue, so that air flows through the aperture 61*a* from the chamber 66 during normal operation. This air flow through the aperture 61*a* helps to ensure that the aperture 61*a* does not become blocked. For example, the pressure in the pipe 67 may be approximately 3 psi (pounds per square inch) and the pressure in the chamber 66 may have a mean value of approximately $3\frac{1}{2}$ inches water gauge; in other words, the orifice 68*a* drops the pressure by about 96%. In another possible example the pressure in the pipe 67 is about 12 psi and the diameter of the aperture 61A is 1 mm; in order to drop the pressure to a sufficient extent the diameter of the orifice 68*a* may be about 0.1 mm.

Figure 8:
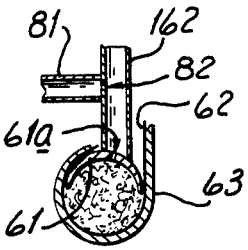
FIG. 8 shows a different way of arranging each pressure tapping.

In FIG. 7 the chamber 66 is shown, for the purpose of illustration, larger than it is preferably constructed in practice. FIG. 8 shows an alternative construction, being a cross-section in a transverse plane immediately downstream of the pipe 162 and looking towards the pipe 162. In this example, the pipe 162 extends all the way to the tongue 61 and in effect serves as a chamber equivalent to the chamber 66 in FIG. 7. A pressure supply pipe 81 is connected to the pipe 162, and an orifice 82 equivalent to the orifice 68*a* in FIG. 7 is formed in the wall of the pipe 162 within the pipe 81.

FIG. 8 also shows that the wrapper web 62 is at this stage folded over the tongue along one side (the left-hand side) by the garniture tape 63. Consequently the aperture 61A is offset to the right from the centre of the tongue.

By way of example, if the total length of the tongue 61 is 9 inches, the pressure tappings 61*a* and 61*b* may be respectively at approximately $\frac{1}{2}$ inch and 2 inches from the downstream end of the tongue.

As shown in FIG. 7 the comparator device 64 comprises a diaphragm 69 lying between chambers 70 and 71 which communicate respectively with the pipes 162 and 163. Capacitance plates 72 and 73 are mounted on opposite sides of the diaphragm 69 (which is of metal or is metal coated), the arrangement preferably being such that the capacitance between the diaphragm and each of the plates 72 and 73 is the same when the diaphragm is unstressed. When there is a difference of pressure between the chambers 70 and 71, the diaphragm is flexed towards one capacitance plate and away from the other, thus creating a differential capacitance. Electrical leads 74, 75 and 76 are connected respectively to the two capacitance plates and to the diaphragm and lead to an electrical circuit 77. The circuit 77 together with the capacitances formed between the diaphragm and the capacitance plates form a bridge circuit (well known per se) which produces an output indicative of the pressure difference at the tapping points 61*a* and 61*b*. This output is averaged over a pre-determined time period by an integrator circuit 78 and the output from the integrator circuit 78 is fed via an amplifier 79 and controls the speed of a motor 80 by which the tow is fed into the condensing cone 60. As already mentioned, the control of the motor speed is such as to maintain the pressure difference between the tapping points 61*a* and 61*b* substantially constant. Upstream of the pulley or pulleys driven by the motor 80 there is provision for stretching the tow in a well known manner.

If the pressure differential detected by the comparator 64 ever changes so significantly as to fall outside a predetermined range, the machine may be arranged to eject the filters formed subsequently from the corresponding part of the tow, while at the same time preferably indicating that this has occurred.

A machine according to this invention may be arranged to optimise the use of tow by varying the degree of stretch in the following way. The tow consumption is monitored, for example, by weighing batches of the finished filters which are produced by the machine; the filters may be conveyed from the machine in trays, and every tray or every Nth tray may be weighed automatically. The weight indications may be used to vary the degree of stretch, while maintaining a constant pressure drop between the tappings 61*a* and 61*b*, so as to minimise the weight of tow material used in the filter manufacture. For example, the degree of stretch may be increased automatically in small steps (of for example 2%) in response to declining weight signals until the stage is reached at which the weight begins to increase, whereupon the stretch is reduced by the same steps until successive weight signals again indicate a weight decrease, whereupon the amount of stretch again is increased by the same small steps, and so on to minimise the weight of the finished filters (i.e. more particularly the amount of tow used to produce them) while maintaining a substantially constant pressure drop.

As an alternative to tray weighing, the filters may be weighed in batches at regular intervals by a weighing conveyor which conveys the filters from the making machine. There is preferably an automatic provision whereby the weighing conveyor is temporarily delayed from operating whenever filters are ejected or samples are taken by hand for inspection.

In the case of a weighing conveyor or, for example, a nucleonic scanning device for continuously monitoring the weight of the filter rod (as used commonly in cigarette making machines), the weight signal is averaged over a cycle occurring at predetermined intervals (e.g. about every minute) long enough not to interfere with the operation of the pressure drop control. Each such average signal (or each tray weight signal) may be transmitted to a logic circuit simply as a digital indication (either 1 or 0) indicative of whether the weight has increased or decreased compared with the previous cycle. The logic circuit, using well-known components, could in addition have a memory recording whether the amount of stretch as a result of the previous cycle was increased or decreased. This "stretch order" is repeated for the next cycle if it previously resulted in a weight reduction, and is reversed if it previously resulted in a weight increase.

Figure 9:
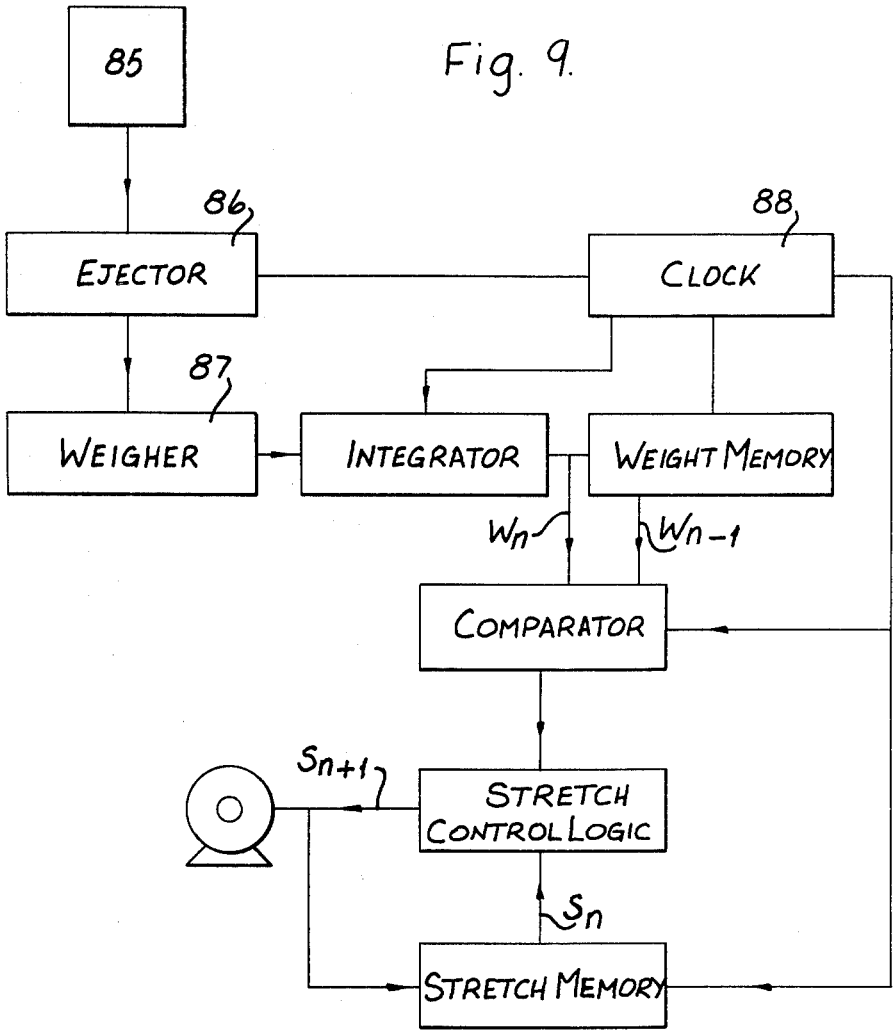
FIG. 9 is a block diagram of a control circuit for minimising the consumption of tow.

FIG. 9 shows diagrammatically how the tow optimisation may be achieved. Filters are delivered by a machine 85 via an ejector 86 (by which unsatisfactory fillers are ejected) and a weighing device 87. Each monitoring cycle is initiated by a clock 88 which may operate at predetermined time intervals or, on the basis of a machine-generated clock pulse, at regular intervals in terms of a filter count; in both cases, when the ejector 86 is operated it delays operation of the clock to ensure that each integrated weight signal is based on the same number of filters.

The weight signal for each cycle is fed via an integrator 88' to a weight memory 89 and (as a signal Wn) to a weight comparator circuit 90. This circuit 90 at the same time receives from the weight memory 89 a signal Wn−1 representing the integrated weight registered during the previous cycle. The comparator compares the signal Wn with signal Wn−1 and transmits to a stretch control logic circuit 91 a digital signal indicating whether Wn is greater or less than Wn−1. A stretch memory circuit 92 informs the circuit 91 what stretch adjustment Sn was applied at the beginning of this cycle (i.e. whether the stretch was increased or decreased compared with the previous cycle) and the circuit 91, on the basis of this information and of the signal received from the comparator 90, transmits a stretch adjustment signal Sn+1 to alter the stretch by one increment before the commencement of the next cycle.

The amount of stretch is adjusted by a step motor 93. This motor may, for example, control the speed of a tow driving motor to alter the amount of stretch; another possibility may be that the step motor 93 adjusts a valve (not shown) controlling a fluid pressure which in turn controls the pressure with which a tow stretching roller bears against the tow.

If the clock 88 is a filter counter, the count frequency (which represents the speed of the continuous filter rod before it is cut into individual filter rods) may be used to adjust automatically the value of the target pressure drop which is controlled by adjusting the tow feed. This is on the basis that the pressure drop during manufacture of the continuous rod (i.e. the pressure difference between the two pressure tappings) is dependent on rod speed since it is results basically from the displacement relative to the tow of air contained in the tow.

The ejector may be arranged to eject a few filter rods at regular fairly long intervals (e.g. once each day) to allow manual measurement of the pressure drop characteristics of the filters with any suitable measuring instrument. On the basis of these measurements adjustment may, when necessary, be made of the target pressure drop signal in the tongue. This would compensate for any error which might gradually creep into the continuous measurement owing to wear of the tongue or of the base member 28 (FIG. 2).

The examples described above are concerned with the manufacture of filter rods including a wrapper of paper or other material around the tow. As an alternative this invention may be applied to a machine which makes filter rods having no wrapper, e.g. as described in British Patent Specification No. 1,169,932.

I claim:

1. A machine for making cigarette filters from filter tow, including means for feeding filter tow towards a rod forming section; means for laterally compressing the filter tow to the cross-section of the finished rod, including a tongue which shapes and compresses the tow to the final cross-section; and means associated with the downstream end of the tongue for sensing the pressure drop through the tow in a region where the tow has nearly reached its final cross-section.

2. A machine according to claim 1 including means for altering the tow feed rate by a variable amount dependent upon the pressure drop measurement so as to maintain the pressure drop substantially constant.

3. A machine according to claim 1 in which the means for sensing the pressure drop comprises two longitudinally spaced pressure tappings in the tongue, and a comparator arranged to compare the pressure at the two pressure tappings.

4. A machine according to claim 3, including a suction conveyor arranged to compress the tow laterally before the tow passes under the tongue.

5. A machine according to claim 4 in which the suction conveyor is a suction wheel arranged to rotate adjacent to a web or tape carrying the tow so as to compress the tow in cooperation with the web or tape.

6. A machine according to claim 5 in which the suction conveyor is arranged to compress the tow approximately to its final cross-sectional area.

7. A machine according to claim 4, including a fluffing device arranged to blow air into the tow from the side before the tow is laterally compressed.

8. A machine according to claim 7 in which the fluffing device includes an annular air outlet through which air is blown into the tow from all sides.

9. A machine according to claim 1 in which the pressure drop sensing means comprises a pressure tapping in the tongue, a hollow member defining a pressure space adjacent to the outer surface of the tongue in the region of the pressure tapping, a pipe which is connected to the pressure space and to a supply of air at a pressure substantially higher than the pressure in the tongue, an orifice by which the pressure from the pipe is dropped as it enters the pressure space to a level slightly above the mean pressure within the tongue in the region of the pressure tapping, the space being connected to a pressure measuring device or pressure comparator.

10. A machine according to claim 1, including means for monitoring the pressure drop through the tow and for adjusting the tow feed so as to maintain the pressure drop substantially constant; a weight monitoring device arranged to monitor the rate of consumption of tow; and a tow stretching device arranged to stretch the tow to a variable extent before the tow is laterally compressed; and a stretch control logic circuit arranged to operate at spaced time intervals to increase or decrease the tow stretch by a predetermined step at each operation, depending upon whether the previous stretch adjustment step increased or decreased the tow consumption, so as to minimise the consumption of tow.

11. A machine for making cigarette filters from filter tow, including means for feeding tow towards a rod-forming unit; means for blowing air into the tow during its movement towards the rod-forming unit; a suction conveyor which is downstream of the blowing means and is arranged to compress the tow laterally while drawing air out of the tow; means downstream of the suction conveyor for sensing the pressure drop through the tow, including two longitudinally spaced pressure tapping means arranged in a tow-shaping tongue means; a comparator means arranged to compare the pressure at the two pressure tapping means; and means for adjusting the tow feed in response to the pressure drop sensor to maintain the pressure drop substantially constant.

12. A machine according to claim 11 in which the suction conveyor is arranged to compress the tow to substantially its final cross-sectional area and said tongue means is arranged to shape the tow to its final cross-section.

13. A machine for making cigarette filters from filter tow, including means for monitoring the pressure drop through the tow and for adjusting the tow feed so as to maintain the pressure drop substantially constant; a weight monitoring device arranged to monitor the rate of consumption of tow; and a tow stretching device arranged to stretch the tow to a variable extent before the tow is laterally compressed; and a stretch control logic circuit arranged to operate at spaced time intervals to increase or decrease the tow stretch by a predetermined step at each operation, depending upon whether the previous stretch adjustment step increased or decreased the tow consumption, so as to minimise the consumption of tow.

14. A method of making cigarette filters from filter tow, including the steps of feeding filter tow while blowing air into the tow to fluff up the tow, laterally compressing the tow while drawing air out of the tow, and then monitoring two longitudinally spaced pressure tapping means so as to determine a pressure drop through the tow, comparing the pressure at the two pressure tapping means, and using the pressure drop signal to control the tow feed so as to maintain the pressure drop substantially constant.

15. A machine for making cigarette filters from filter tow, including means for feeding filter tow towards a rod-forming section; means for laterally compressing the filter tow to the cross section of the finished rod, including a tongue which shapes and compresses the tow to the final cross section; and means for measuring the pressure drop through the tow, comprising two longitudinally spaced pressure tapping means in the tongue, and a comparator arranged to compare the pressures at the two pressure tapping means.

16. A machine according to claim 15, in which each pressure tapping means comprises means defining a pressure space adjacent to the outer surface of the tongue, a pipe which is connected to the pressure space and to a supply of air at a pressure substantially higher than the pressure in the tongue, an aperture formed in the tongue and communicating with the pressure space, and an orifice by which the pressure from the pipe is dropped as it enters the pressure space to a level slightly above the mean pressure within the tongue in the region of the aperture.

17. A machine for making rod-like articles of the cigarette industry from a filler material, including means for feeding the filler material toward a rod-forming section; means for laterally compressing the filler material to a cross section of a finished rod, including a tongue means for shaping and compressing the filler material to a final cross section; and means associated with the downstream end of the tongue means for sensing a pressure drop through the filler material in a region where the filler material has nearly reached its final cross section.

18. A machine according to claim 17, wherein said means for sensing a pressure drop comprises two longitudinally spaced pressure tapping means.

19. A machine according to claim 18, in which each pressure tapping means comprises means defining a pressure space adjacent to the outer surface of the tongue means, a pipe which is connected to the pressure space and to a supply of air at a pressure substantially higher than the pressure in the tongue means, an aperture formed in the tongue means and communicating with the pressure space, and an orifice by which the pressure from the pipe is dropped as it enters the pressure space to a level slightly above the mean pressure within the tongue means in a region of the aperture.

* * * * *